US009216503B2

(12) United States Patent
Lawrence

(10) Patent No.: US 9,216,503 B2
(45) Date of Patent: Dec. 22, 2015

(54) MULTI-TOOL WRENCH

(71) Applicant: Glenford Lawrence, Ft. Lauderdale, FL (US)

(72) Inventor: Glenford Lawrence, Ft. Lauderdale, FL (US)

( * ) Notice: Subject to any disclaimer, the term of this patent is extended or adjusted under 35 U.S.C. 154(b) by 0 days.

(21) Appl. No.: 14/338,953

(22) Filed: Jul. 23, 2014

(65) Prior Publication Data

US 2015/0026899 A1 Jan. 29, 2015

Related U.S. Application Data

(60) Provisional application No. 61/857,338, filed on Jul. 23, 2013.

(51) Int. Cl.

| | |
|---|---|
| ***B25B 13/00*** | (2006.01) |
| ***B25F 1/04*** | (2006.01) |
| ***B26B 5/00*** | (2006.01) |
| ***B26B 11/00*** | (2006.01) |

(52) U.S. Cl.
CPC . *B25F 1/04* (2013.01); *B26B 5/001* (2013.01); *B26B 11/00* (2013.01)

(58) Field of Classification Search
CPC ..... B25F 1/02; B26B 11/008; B26B 5/001; B26B 11/10
USPC ..... 7/138, 165, 158, 163, 901; 81/52
See application file for complete search history.

(56) References Cited

U.S. PATENT DOCUMENTS

| | | | | |
|---|---|---|---|---|
| 1,187,842 | A * | 6/1916 | Kaas | 7/168 |
| 4,122,569 | A * | 10/1978 | Hitchcock | 7/134 |
| 4,783,867 | A * | 11/1988 | Tsao | 7/160 |
| 4,979,407 | A * | 12/1990 | Hernandez et al. | 81/3.09 |
| 5,345,636 | A | 9/1994 | Lamons | |
| 5,459,647 | A * | 10/1995 | Betts | 362/119 |
| 6,016,728 | A | 1/2000 | Bohl | |
| 6,234,051 | B1 | 5/2001 | Bareggi | |
| 6,334,693 | B1 | 1/2002 | Lee | |
| 7,114,824 | B2 | 10/2006 | Picone | |
| 7,174,590 | B1 * | 2/2007 | Quenzi | 7/158 |
| 8,342,065 | B2 * | 1/2013 | Shaulov | 81/439 |
| 2009/0000038 | A1 * | 1/2009 | Padden | 7/128 |
| 2011/0303052 | A1 | 12/2011 | Chen | |

* cited by examiner

*Primary Examiner* — Monica Carter
*Assistant Examiner* — Melanie Alexander
(74) *Attorney, Agent, or Firm* — Daniel Boudwin; Global Intellectual Property Agency LLC

(57) ABSTRACT

A multi-tool is provided having a first end having a socket wrench, a second end having a retractable blade, a plurality of interchangeable wrench heads that are affixable over the second end of the tool when the blade is retracted, a screwdriver that is pivotally deployable from the body of the tool, an extendable magnet that is pivotally deployable from the reverse side of the tool, and at least one level. An alternative embodiment of the present multi-tool further includes a light to be used to illuminate dim work environments. The interchangeable wrench heads include an open-ended wrench head, an adjustable open-ended wrench head, a box end wrench head, and other such wrench head attachments.

8 Claims, 4 Drawing Sheets

MULTI-TOOL WRENCH

CROSS REFERENCE TO RELATED APPLICATION

This application claims the benefit of U.S. Provisional Application No. 61/857,338 filed on Jul. 23, 2013 entitled "Multi Wrench." The above identified patent application is herein incorporated by reference in its entirety to provide continuity of disclosure.

BACKGROUND OF THE INVENTION

1. Field of the Invention

The present invention relates to wrenches. More specifically, the present invention relates to wrenches having a variety of interchangeable attachments, including various types of wrench heads, and a variety of deployable tool components, such as blades and screwdrivers.

Multi-tools are convenient because they provide individuals with a number of selectively deployable tools within a single, compact device. This reduces the number of different tools that individuals must carry with them, without sacrificing any usability. Many different types of laborers are forced to carry a large toolbox or tool belt filled with a huge variety of tools on their person at all times. These cumbersome loads of tools can tire the individual carrying them over time and negatively impact his or her ability to perform his or her tasks. In addition to the weight or general cumbersome nature of carrying a large number of tools that are suited only for a single specific purpose, it can be extremely time consuming to sort through a large number of tools to locate the tool that is needed for the given task. This can be extremely frustrating and Therefore, there is a need in the prior art for multi-tools that include the functionality of as many different types of tools as possible into a single compact device.

2. Description of the Prior Art

Devices have been disclosed in the prior art that relate to adjustable wrenches and multi-tools. These include devices that have been patented and published in patent application publications. These devices generally relate to wrenches having a plurality of interchangeable head components. The following is a list of devices deemed most relevant to the present disclosure, which are herein described for the purposes of highlighting and differentiating the unique aspects of the present invention, and further highlighting the drawbacks existing in the prior art.

Various types of wrenches having interchangeable head components or multi-tools having wrench head components are known in the prior art. Some of these types of devices comprise tools having a plurality of different wrench heads that are removably and interchangeably affixed to the body of the tool via a locking means, such as spring-biased pin locking mechanisms. These types of wrenches having interchangeable heads may offer open-ended wrench heads, adjustable open-ended wrench heads, box end wrench heads, socket wrench heads, or other such types of wrench heads. However, these types of wrenches having interchangeable heads offer limited functionality beyond the wrench head components. Conversely, the present invention comprises a retractable blade, integral vertical and horizontal levels, a pivotally deployable screwdriver, and various other components that offer vastly more functionality than conventional tools having interchangeable wrench heads.

Some types of multi-tools comprise a wrench head disposed at a first end of the body and a screwdriver head, or other such tool, disposed at an opposite, second end of the body of the tool. Other types of multi-tools offer a hollow, openable body that is adapted to removably hold other tool attachments therein. Users can unlock the body of the tool, open the body, remove the necessary components therefrom, and then attach those components for use. These types of multi-tools offers users with a plurality of different deployable tool options. These types of multi-tools require a significant amount of work by the user because the tool have to opened, closed, and adjusted every time that the user wishes to change which tools he or she is using. Conversely, the present invention provides a multi-tool that requires minimal manipulation by the user in order to make use of the various tool components and, therefore, is much simpler and more intuitive to use.

The present invention comprises a tool having a first end having a socket wrench, a second end having a retractable blade, a plurality of interchangeable wrench heads that are affixable over the second end of the tool when the blade is retracted, a screwdriver that is pivotally deployable from the body of the tool, an extendable magnet that is pivotally deployable from the reverse side of the tool, and at least one level. The present invention thereby provides users with a substantial amount of functionality with a single, convenient tool.

The present invention substantially diverges in design elements from the prior art and consequently it is clear that there is a need in the art for an improvement to existing multi-tool devices. In this regard the instant invention substantially fulfills these needs.

SUMMARY OF THE INVENTION

In view of the foregoing disadvantages inherent in the known types of multi-tools now present in the prior art, the present invention provides a new multi-tool wherein the same can be utilized for providing convenience for the user.

It is therefore an object of the present invention to provide a new and improved multi-tool device that has all of the advantages of the prior art and none of the disadvantages.

It is another object of the present invention to provide users with the necessary tools for a wide array of tasks available in a convenient manner.

Another object of the present invention to provide a multi-tool device that comprises a retractable head.

Another object of the present invention is to provide a multi-tool device that comprises a plurality of interchangeable wrench heads.

Yet another object of the present invention is to provide a multi-tool device that is customizable based upon the task that the user is seeking to accomplish.

Still yet another object of the present invention is to provide a multi-tool device that comprises a plurality of pivotally deployable tool components.

Still yet another object of the present invention is to provide a multi-tool device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
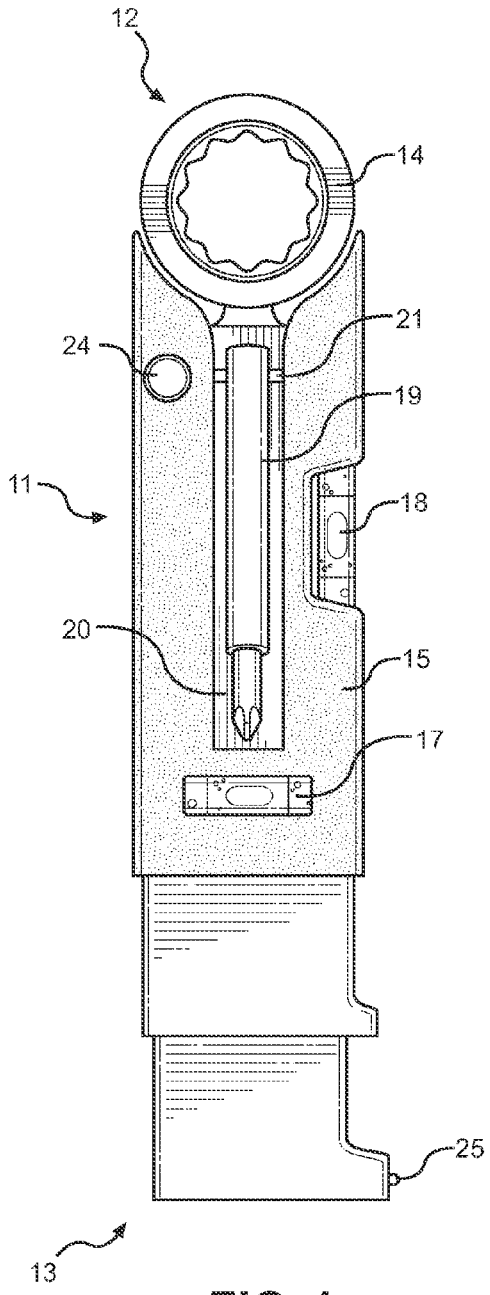
FIG. 1 shows a view of the first side of the present invention.

Reference is made herein to the attached drawings. Like reference numerals are used throughout the drawings to depict like or similar elements of the present multi-tool wrench. For the purposes of presenting a brief and clear description of the present invention, the preferred embodiment will be discussed as used for providing individuals with a number of different tools in a single, convenient, and easily-accessible device. The figures are intended for representative purposes only and should not be considered to be limiting in any respect.

Figure 2:
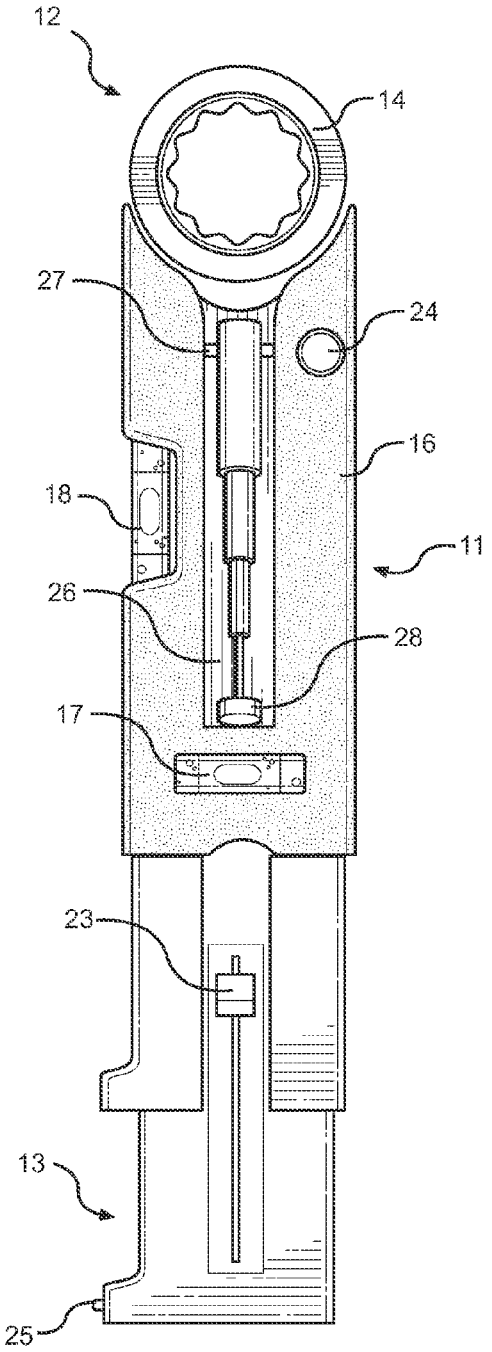
FIG. 2 shows a view of the second side of the present invention.
Figure 3:
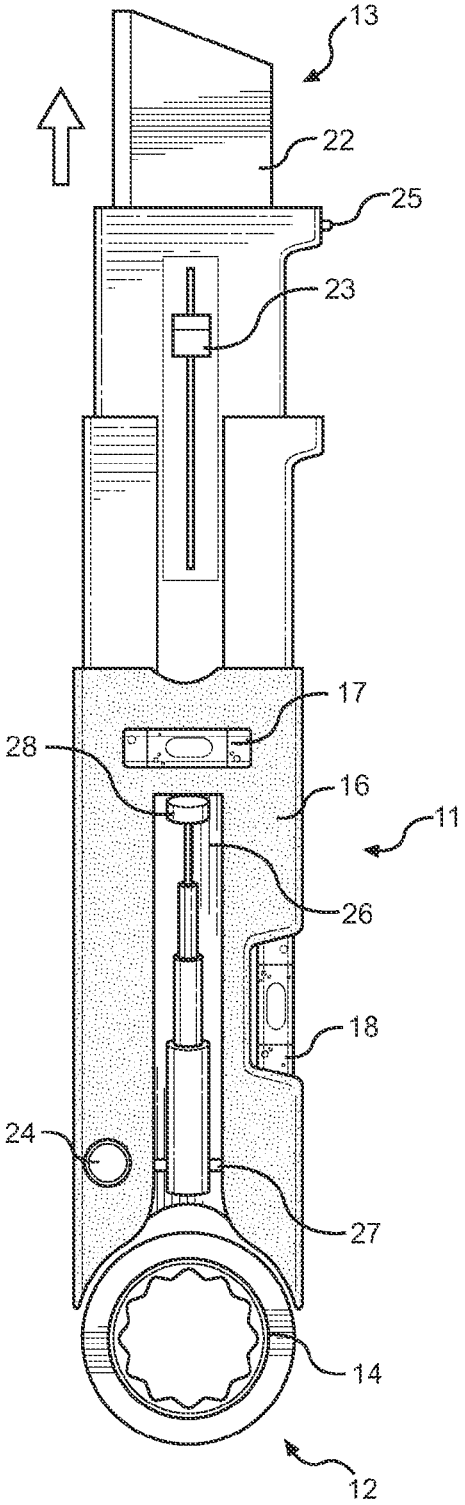
FIG. 3 shows a view of the second side of the present invention with the retractable blade in its extended configuration.

Referring now to FIGS. 1-3, there are shown views of the opposing sides of the present invention and a view of the second side of the present invention with the retractable blade in its extended configuration. The present multi-tool comprises a body 11, a first end 12 having a ratcheting wrench 14 disposed thereon, and a second end 13. The ratcheting wrench 14 comprises a conventional ratcheting wrench design as is commonly known in the prior art. The second end 13 of the present invention comprises a retractable blade 22, which is controlled by an actuator 23. As depicted, the actuator 23 is a slide mechanism that causes the retractable blade 22 to be deployed when it is moved to a distal position and retracted when it is moved to a proximal position, i.e. towards the center point of the body 11. The actuator 23 comprises a slidable button disposed on the exterior surface of the present invention and a blade shuttle that is disposed within an interior guide channel. The base of the retractable blade 22 rests against the interior blade shuttle and the button is operably connected to the blade shuttle, thereby allowing a user to control the position to the blade 22. The retractable blade 22 is removable from the guide channel so that it can be replaced as necessary. However, no claims is made as to the specific mechanism that makes the blade 22 retractable and the depicted embodiment is merely intended to be exemplary.

The body 11 portion of the present invention comprises two opposing lateral sides: a first side 15 comprising a deployable screwdriver 19 disposed thereon and a second side 16 comprising a deployable magnet 28 disposed thereon. The screwdriver 19 is attached to the body 11 via a hinge 21 and rests within a first recess 20 in the first side 15 of the body 11. The first recess 20 is of sufficient depth so that the screwdriver 19 is securely held therein, without interfering with an individual's ability to grip or otherwise utilize the present invention. The screwdriver 19 comprises a Phillips head screwdriver, a flat head screwdriver, or any other such screwdriver. The hinge 21 is adapted to provide a 180-degree range of movement so that the screwdriver 19 can transition from a position securely within the first recess 20 to a position in which the screwdriver 19 extends substantially beyond, and lies flush against, the ratcheting wrench head 14. The magnet 28 is attached to the opposing second side 16 of the body 11 in the same manner, i.e. via a hinge 27 that provides a 180-degree range of movement, and rests within a complementary second recess 26 disposed thereon. The magnet 28 comprises a telescoping member and a head portion composed of magnetic material as currently known in the prior art. In use, individuals can deploy the magnet 28 by rotating it upwardly, extending the telescoping member, and then inserting the extended magnet 28 into crevasses and other such locations to retrieve otherwise irretrievable metallic articles, such as nails, screws, and other fasteners.

The body 11 portion of the present invention further comprises at least one vertical level 17 and at least one horizontal level 18 disposed thereon. The levels 17, 18 are situated perpendicularly to each other, thereby the ability to ascertain both the vertical and horizontal levelness of an article. The elongated edge of the body 11 is substantially flat, allowing the present invention to be laid flush against a planar surface and thereafter used to determine whether that surface is both horizontally and vertically level. The levels 17, 18 comprise bubble levels, as depicted, or any other type of level known in the prior art.

Figure 5:
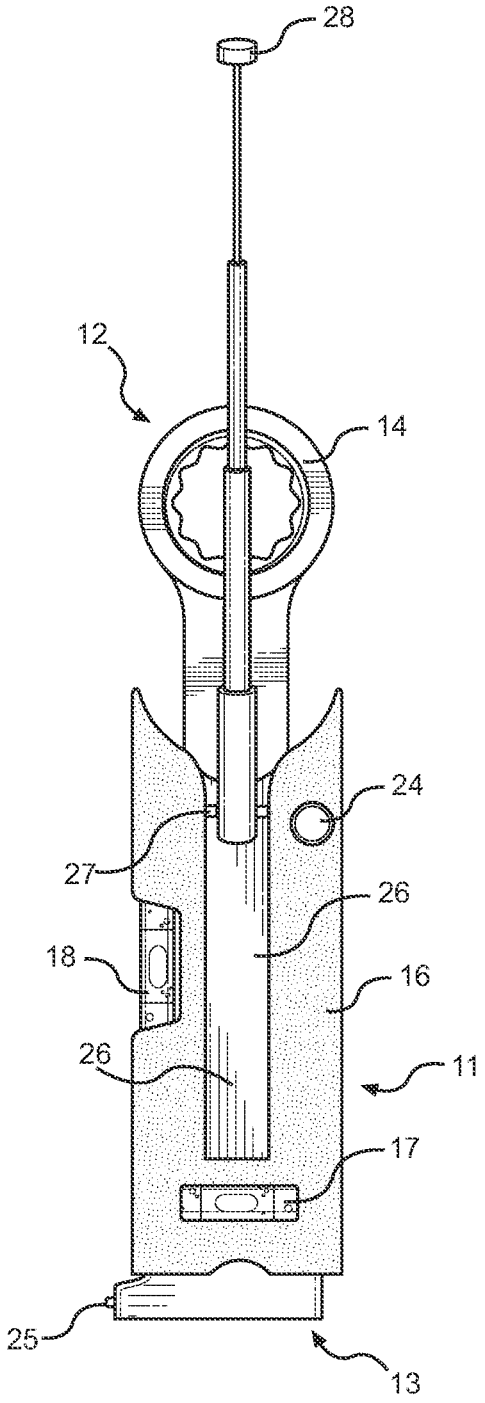
FIG. 5 shows a view of the second side of the present invention with the magnet in its extended configuration.

The body 11 portion is slidably disposed on the present invention, thereby allowing the present invention to transition between a configuration wherein the second end 13 is substantially exposed, as seen in FIGS. 1 and 2, and a configuration wherein the first end 12 is substantially exposed, as seen in FIG. 5. When the first end 12 is substantially exposed, the second end 13 is covered by the distal portion of the body 11. This prevents the actuator 23 from being inadvertently moved when the present invention is in use, thereby preventing the blade 22 from being inadvertently extended therefrom. Furthermore, this configuration provides additional leverage when using the ratcheting wrench 14 because the gripping surface, i.e. the body 11, is situated farther from the fulcrum when in use, thereby increasing the amount of torque exerted.

The present invention further comprises a light disposed within the interior of the body 11. The light is controllable via at least one button 24 positioned on the exterior surface of the body. The light comprises any type of illumination mean s currently known in the prior art, including LED lights and the like. The light is preferably positioned within the body 11, below the neck of the ratcheting wrench 14. The light is situated along the longitudinal axis of the present invention, extending from the area between the body 11 and the neck of the ratcheting wrench 14.

Figure 4:
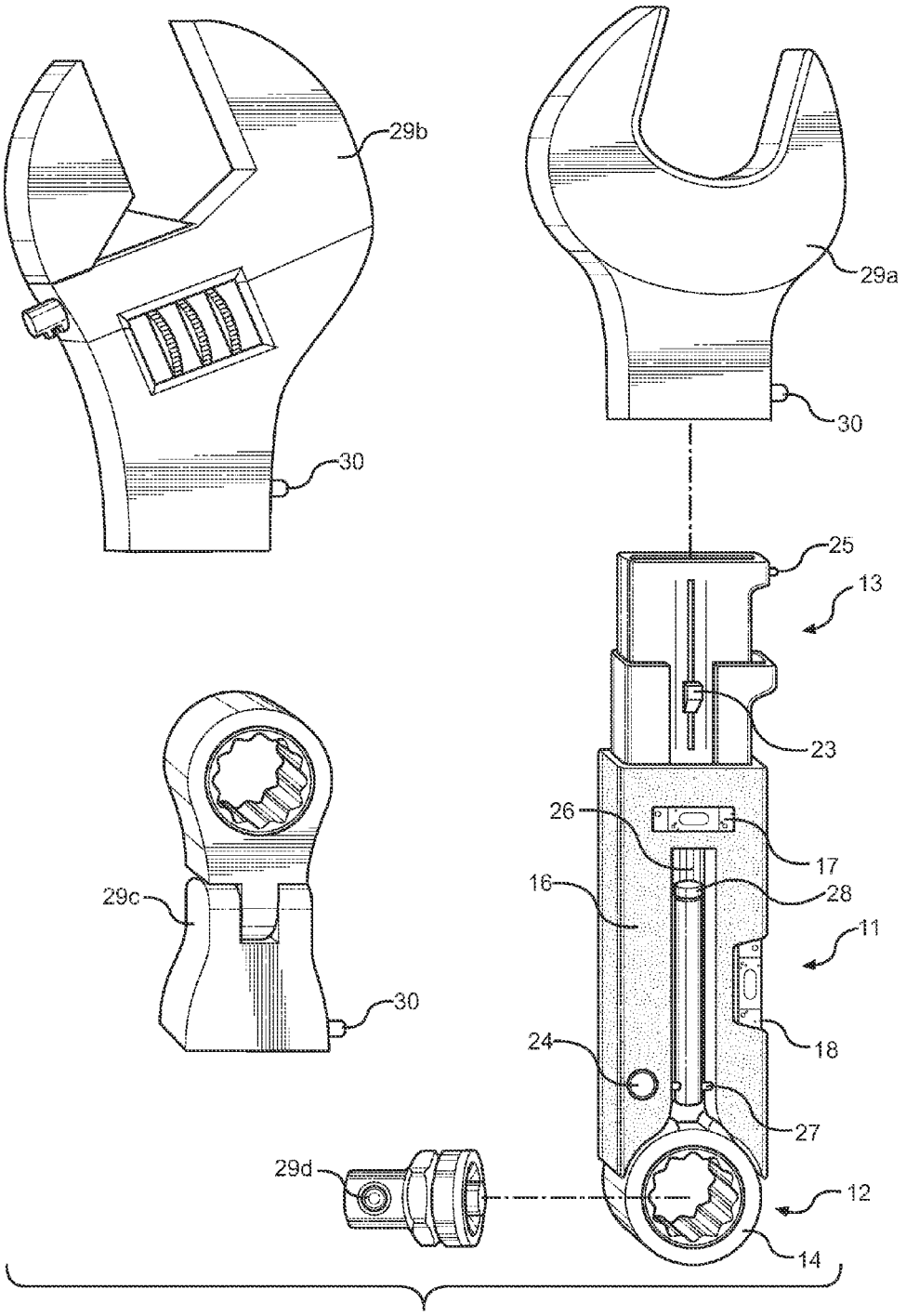
FIG. 4 shows a perspective view of the present invention with a plurality of interchangeable wrench head components.

Referring now to FIG. 4, there is shown a perspective view of the present invention with a plurality of interchangeable wrench head components. The present invention further comprises a plurality of interchangeable wrench heads 29*a*, 29*b*, and 29*c* that are interchangeably affixable to the second end 13 of the present invention. The interchangeable heads comprise an open-ended wrench 29*a*, an adjustable open-ended wrench 29*b*, a hinged box end wrench 29*c*, and other such wrench head attachments. The interchangeable wrench heads 29*a*, 29*b*, 29*c* are affixed over the second end 13 when the blade 23 is fully retracted. The interchangeable heads 29*a*, 29*b*, 29*c* are affixed in place via an attachment mechanism. The attachment mechanism comprises a spring-loaded pin 25 that engages with a complementary slot 30 or aperture disposed on the interchangeable heads 29*a*, 29*b*, 29*c*. When the pin 25 is depressed, an interchangeable head 29*a*, 29*b*, 29*c* can be placed thereover, which then causes the pin 25 to engage with the slot 30 or aperture when aligned therewith. The pin 25 then acts as an obstruction holding the interchangeable heads 29*a*, 29*b*, 29*c* in place and preventing it from being removed or slipping therefrom. However, the depicted embodiment is merely intended to be exemplary and no such claim is made as to the specific mechanism for holding the interchangeable heads 29*a*, 29*b*, 29*c* in place. The present invention further comprises a socket wrench head 29*d* that is removably engageble within the ratcheting wrench 14 portion of the present invention.

Referring now to FIG. 5, there is shown a view of the second side of the present invention with the magnet in its extended configuration. As herein described, the present invention comprises a magnet 28 that is pivotally attached to the second side 16 of the present invention via a hinge 27 that has a 180-degree range of movement. The magnet 28 comprises a telescoping member and a head composed of magnetic material.

Figure 6:
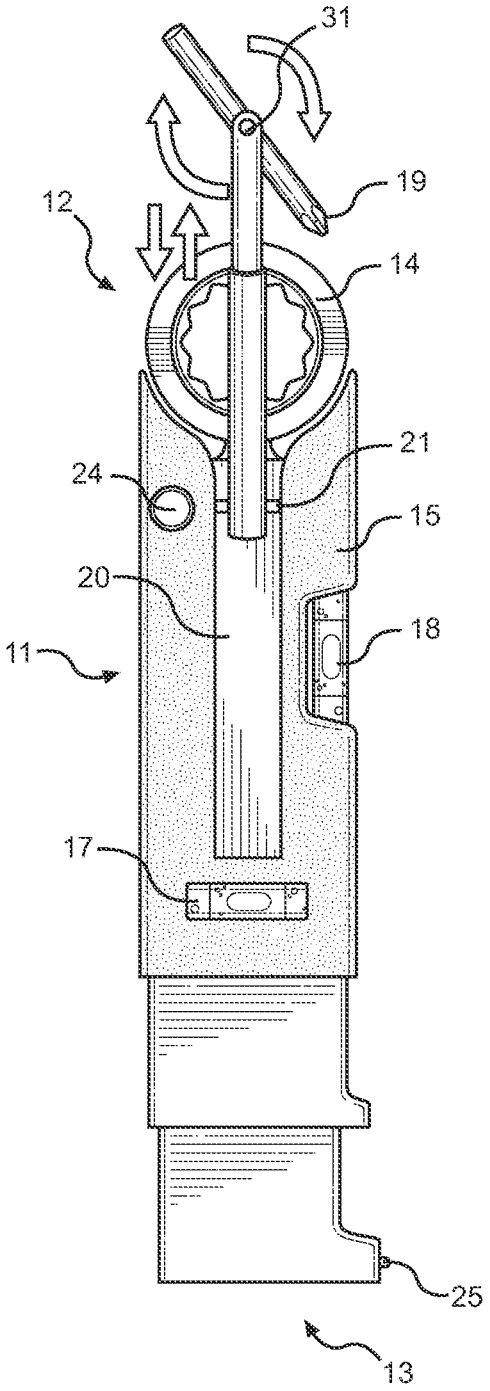
FIG. 6 shows a view of the first side of an alternative embodiment of the present invention having a pivotally deployable screwdriver.

Referring now to FIG. 6, there is shown a view of the first side of an alternative embodiment of the present invention having a pivotally deployable screwdriver. In an alternative embodiment of the present invention, the screwdriver 19 further comprises a second pivotal and slidable attachment 31 disposed at a midpoint along the elongated member, between the head of the screwdriver 19 and the hinge 21. In the aforedescribed embodiment of the present invention, as depicted in FIG. 1, the head portion and the elongated body portion of the screwdriver 19 are a single, contiguous member. However, in the depicted alternative embodiment of the present invention, the head of the screwdriver 19 is connected to the elongated body portion via a series of spring-biased, slidable arms, which are attached to the inner tubular portion of the screwdriver 19. The head of the screwdriver 19 can therefore be pulled therefrom, rotated 180-degrees, and then released, thereby causing the head of the screwdriver 19 to rest within the inner tubular portion of the screwdriver 19. This protects the head of the screwdriver 19 from damage and ensures that there are no exposed portions of the present invention that are prone to causing injury.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A multi-tool, comprising:

a body having a first side, a second side, a first end, and a second end;

a ratcheting wrench head disposed on said first end;

a retractable blade disposed on said second end;

said first side having a screwdriver head pivotally affixed thereto;

said second side having a magnet pivotally affixed thereto;

a plurality of interchangeable heads removably affixable to said second end via an attachment mechanism when said retractable blade is in its retracted configuration.

2. The device of claim 1, wherein:

said body further comprises an actuator slidably disposed on said multi-tool.

3. The device of claim 1, further comprising at least one level disposed thereon.

4. The device of claim 1, wherein said magnet is telescoping.

5. The device of claim 1, wherein said attachment mechanisms comprises a spring-loaded pin that engages with a complementary portion disposed on said interchangeable heads.

6. The device of claim 1, further comprising a light disposed thereon.

7. The device of claim 1, wherein said screwdriver comprises a head portion and an elongated member portion and wherein said head portion is rotatably affixed to said elongated member portion.

8. The device of claim 2, wherein the actuator is configured to deploy the retractable blade when the actuator is moved to a distal position and retract the retractable blade when the actuator is moved to a proximal position.

* * * * *